US010363682B2

(12) United States Patent
Firth

(10) Patent No.: US 10,363,682 B2
(45) Date of Patent: Jul. 30, 2019

(54) POWER TOOL

(71) Applicant: POWER BOX AG, Zug (CH)

(72) Inventor: Robert Firth, York (GB)

(73) Assignee: POWER BOX AG, Zug (CH)

( * ) Notice: Subject to any disclaimer, the term of this patent is extended or adjusted under 35 U.S.C. 154(b) by 0 days.

(21) Appl. No.: 14/414,656

(22) PCT Filed: Mar. 6, 2014

(86) PCT No.: PCT/GB2014/050664

§ 371 (c)(1),
(2) Date: Jan. 13, 2015

(87) PCT Pub. No.: WO2014/177831

PCT Pub. Date: Nov. 6, 2014

(65) Prior Publication Data

US 2016/0075051 A1 Mar. 17, 2016

(30) Foreign Application Priority Data

Apr. 30, 2013 (GB) ..... 1307756.5

(51) Int. Cl.

| | |
|---|---|
| ***B27B 27/06*** | (2006.01) |
| ***B27B 27/08*** | (2006.01) |
| ***B27B 27/02*** | (2006.01) |
| ***B27B 5/18*** | (2006.01) |

(52) U.S. Cl.

CPC ..... *B27B 27/08* (2013.01); *B27B 5/184* (2013.01); *B27B 5/187* (2013.01); *B27B 27/02* (2013.01); *B27B 27/06* (2013.01)

(58) Field of Classification Search

CPC ..... B27B 27/02; B27B 27/06; B27B 27/08; B27B 5/184; B27B 5/187; B27B 27/10; B27B 25/10; B27B 27/04; B27B 5/207; B23D 47/025; B23D 59/001; Y10T 83/6612; Y10T 83/773

See application file for complete search history.

(56) References Cited

U.S. PATENT DOCUMENTS

| | | | | |
|---|---|---|---|---|
| 2,601,878 A * | 7/1952 | Anderson | ..... | B27B 5/181 144/1.1 |
| 4,086,837 A * | 5/1978 | Dyck | ..... | B21D 37/04 83/637 |
| 5,233,891 A * | 8/1993 | Arnold | ..... | B25B 13/461 81/177.85 |
| 7,066,627 B1 * | 6/2006 | Chen | ..... | B23D 59/003 362/259 |
| 8,186,257 B2 | 5/2012 | Heflin et al. | | |

(Continued)

FOREIGN PATENT DOCUMENTS

WO 2009090359 A2 7/2009

*Primary Examiner* — Kenneth E Peterson
*Assistant Examiner* — Liang Dong
(74) *Attorney, Agent, or Firm* — Volpe and Koenig, P.C.

(57) ABSTRACT

The invention relates to powered cutting apparatus which includes a cutting unit mounted on one or more slide members and provided to perform a cutting action on a workpiece mounted on a base to which the one or more slide members are attacked by support legs. The apparatus includes at least one fence with a contact surface for the workpiece and the fence can be selectively positioned on any of a plurality of guide means provided on the base to aid in the performance of the cutting action.

15 Claims, 13 Drawing Sheets

(56) References Cited

U.S. PATENT DOCUMENTS

| | | | | |
|---|---|---|---|---|
| 2001/0047706 | A1* | 12/2001 | Parks | B23D 47/025<br>83/435.12 |
| 2003/0075033 | A1* | 4/2003 | Speakman | B23D 47/025<br>83/477.2 |
| 2006/0201299 | A1* | 9/2006 | Santa Ana | B23D 45/024<br>83/468.3 |
| 2010/0116111 | A1* | 5/2010 | Rybka | B23D 59/001<br>83/446 |

* cited by examiner

POWER TOOL

The invention to which this application relates is to apparatus which can be used to perform cutting actions on one or more work pieces such as, but not exclusively, work pieces in the form of sheet material such as, for example, wooden and/or laminate flooring.

With any form of work piece which is required to be fitted into a particular type of area, there is often a need for the same to be cut to suit particular area dimensions and/or area edges and very often a need for different cut types to be performed, such as rip cuts, cross cuts and mitre cuts. For example, when fitting strips of laminate flooring in a room to form a floor surface, at least certain of the strips of laminate will be required to be cut to a particular length or width, typically when the same are to be located at or adjacent to walls of the room or other structures within the building. Conventionally, this can be done manually by using a saw but often the accuracy and quality of cut which can be achieved, is unsuitable and can lead to the finished floor having a poor appearance and/or not fitting the floor space correctly. A further problem is that the manual cutting of the laminate sheet material can be tiring for the person and therefore on occasion, they may attempt to perform the cutting action using other power tools which may not be suitable for the particular purpose and can therefore be dangerous to use and therefore may not achieve a particularly attractive finish.

It is also known to provide apparatus which is of a size and scale which can accept the dimension of the sheet material to cut the same but that apparatus tends to be of a form which is located in a work shop or other permanent location and therefore cannot be used on site to perform the cutting operation on the sheet material. This form of apparatus is therefore of little use to a person who may be fitting the laminate flooring in a particular room or confined or restricted space as, in many cases, the dimensions of the area in which the sheet material, such as wood floor, composite wood laminates, skirting boards, door casings, floor panels, paneling, and the like, is to be fitted are not known and therefore not all of the items of sheet material can be cut to size prior to transporting the same to site for fitting and therefore cutting on site is required to be performed.

Smaller versions of these tools have been provided, to allow a person to use the apparatus within a more confined or restricted space. However, those that do exist still experience problems. For example, U.S. Pat. No. 8,186,257 B2 provides a laminate-flooring saw system that can be used to create different cuts.

An aim of the present invention is to provide apparatus of a form which can be used to perform a cutting action on a work piece, more typically a relatively thin elongate workpiece such as laminate flooring, flooring panels or the like and to allow the cutting action to be performed on site and in an accurate manner and providing an increased number of cutting angles that a work piece may be cut along.

A further aim of the present invention is also to provide such an apparatus with a means to ensure accurate cutting along the cutting line is achieved.

A yet further aim of the present invention is to provide a cutting apparatus that will maximise the size of workpiece which can be cut using the apparatus.

In a first aspect of the invention, there is provided a powered cutting apparatus, said apparatus comprising a base having a surface onto which a work piece to be cut can be placed, first and second spaced parallel slide members, a fence having a surface for location of the work piece therewith and a cutting unit, said cutting unit including a rotatable blade, a guard for the same, and drive means for rotating said blade when switched on, said cutting unit mounted on, and to one side of, the slide members such that the blade is spaced to one side of the same along a plane substantially parallel with the said surface of the base; wherein the base includes first guide means provided for location of the said fence such that the said fence surface is positioned in a plane substantially parallel with the longitudinal axis of said slides, and wherein at least second guide means are provided which when said fence is located therewith, allow the position of said fence to be angularly adjustable by the user.

The present invention therefore has the advantage that the fence provided on the power cutting apparatus when positioned with the second guide means can be selectively positioned so as to be adjustable across a wide range of angles, allowing a work piece to be cut with much greater accuracy. Unlike previous examples in the prior art, the apparatus of the present invention provides a user with the facility to make suitable cutting styles such as any of cross cuts, rip cuts, and/or a wide variety of mitre cuts on a work piece.

In one embodiment, the positioning of the fence with said first and/or second guide means can be selected and locked using one or more locking means. Typically, said locking means comprise one or more threaded bolts or screws and/or a cam assembly.

In one embodiment, said first guide means are provided in the form of at least two spaced apart slots or rails on the base of the apparatus. Typically, the longitudinal axes of the slots are substantially perpendicular to the longitudinal axis of the slides. Further typically, said first guide means are located in the apparatus such that the cutting plane of the rotatable blade is located between the first guide means and the slides.

In one embodiment, when the fence is located on the first guide means, said fence is located with both slots. Typically, the length of said slots defines the extent of variation in the position of the contact surface of said fence, and the slots guide the movement of the fence to ensure that the contact surface of the fence against which the work piece is located, is maintained in a substantially parallel relationship with the cutting line of the rotatable blade.

In one embodiment, said second guide means is provided as a single slot or rail on the base of the apparatus. Typically the said slot extends inwardly from an edge of the base and the longitudinal axis of the same is substantially parallel with the longitudinal axes of the slides and the line of cut of the rotatable blade Typically, when the fence is located with the second guide means, said fence is rotatably adjustable with respect to said slot, allowing angular adjustment of the contact surface of said fence and against which the work piece is located.

In one embodiment, when said fence is located with said second guide means, said fence is pivotally movable within a predefined range, such as ±45°, and/or movable to predefined angular locations.

Thus, when said fence is located with said second guide means, the user may position the work piece across a broad range of angles with respect to the cutting plane of the rotatable blade, providing an increased number of mitre cutting options for the user.

In one embodiment, the fence includes clamp means which has a portion that can be tightened onto the work piece to clamp the same in position.

In one embodiment, at least a third guide means are provided. Typically, said third guide means are provided as one or more slots or rails on the base of the apparatus. Further typically, said third guide means extend from an edge of the base which opposes that edge of the base from which the first guide means extend.

In one embodiment, the powered cutting apparatus further comprises an adjustable cutting guideline generator. Typically, said adjustable cutting guideline generator is mounted on the cutting unit. Further typically, said adjustable cutting guideline generator is mounted on the guard of the cutting unit. Yet further typically, said cutting guideline generator is mounted at the leading face of said guard.

In one embodiment, said adjustable cutting guideline generator includes a laser or LED line generator, which can be provided as part thereof or mounted adjacent thereto. Alternatively, or additionally, other illumination means may be provided as part of the cutting guideline generator.

In one embodiment, the position of the laser or LED line generator is adjustable so as to allow the guideline produced to be aligned with the line of cut, or both, or either, sides of the kerf of the blade.

In one embodiment, the slides of the powered cutting apparatus are mounted on support legs to hold the same in position at first and second positions above the base. Typically a gap is provided between the top surface of the base and the underside of the lower of the slides.

In one embodiment, one but typically all of the said support leg include a portion adjacent the base which is located further from the cutting line of the rotatable blade than an upper portion of the support leg.

Thus, the dog-leg shape of the support legs for the slides allow an increase in the width of material that may be cut from the sheet material.

In a further aspect of the invention, there is provided a powered cutting apparatus, said apparatus including a base onto which a work piece to be cut can be placed, at least first and second slide members, a cutting unit including a rotatable blade, a guard for the same, and drive means for rotating said blade when switched on, said cutting unit mounted on and to one side of the slide members to space the blade from the slide members and wherein said apparatus further includes an adjustable cutting guideline generator including a laser or LED line generator.

In one embodiment, said adjustable cutting guideline generator is mounted on the cutting unit. Typically, said adjustable cutting guideline generator is mounted on the guard of the cutting unit. Further typically, said cutting guideline generator is mounted at the leading face of said guard.

In one embodiment, the position of the laser or LED is adjustable so as to allow the guideline produced by the line generator to be aligned with the line of cut, or both, or either, sides of the kerf of the blade.

In yet a further aspect of the invention, there is provided a powered cutting apparatus, said apparatus comprising a base onto which a work piece to be cut can be placed, at least one slide member, a cutting unit including a rotatable blade, a guard for the same, and drive means for rotating said blade when switched on, said cutting unit mounted on and to one side of the slide members such that the blade is spaced from the slide members, and wherein the slide members are mounted on one or more support legs to hold the same in position with respect to the base, and at least one of said support legs has a first portion which is located at a greater distance from the cutting line of the blade than a further portion of the said support leg.

Typically said slide members are located on the said further portion of the support leg.

In one embodiment, said "dog-leg" profile is provided such that a lower portion of said support legs is located outwardly from the cutting plane of the rotatable blade with respect to an upper portion of the support legs.

Embodiments of the present invention will now be described with reference to the accompanying figures, wherein.

Figure 1:
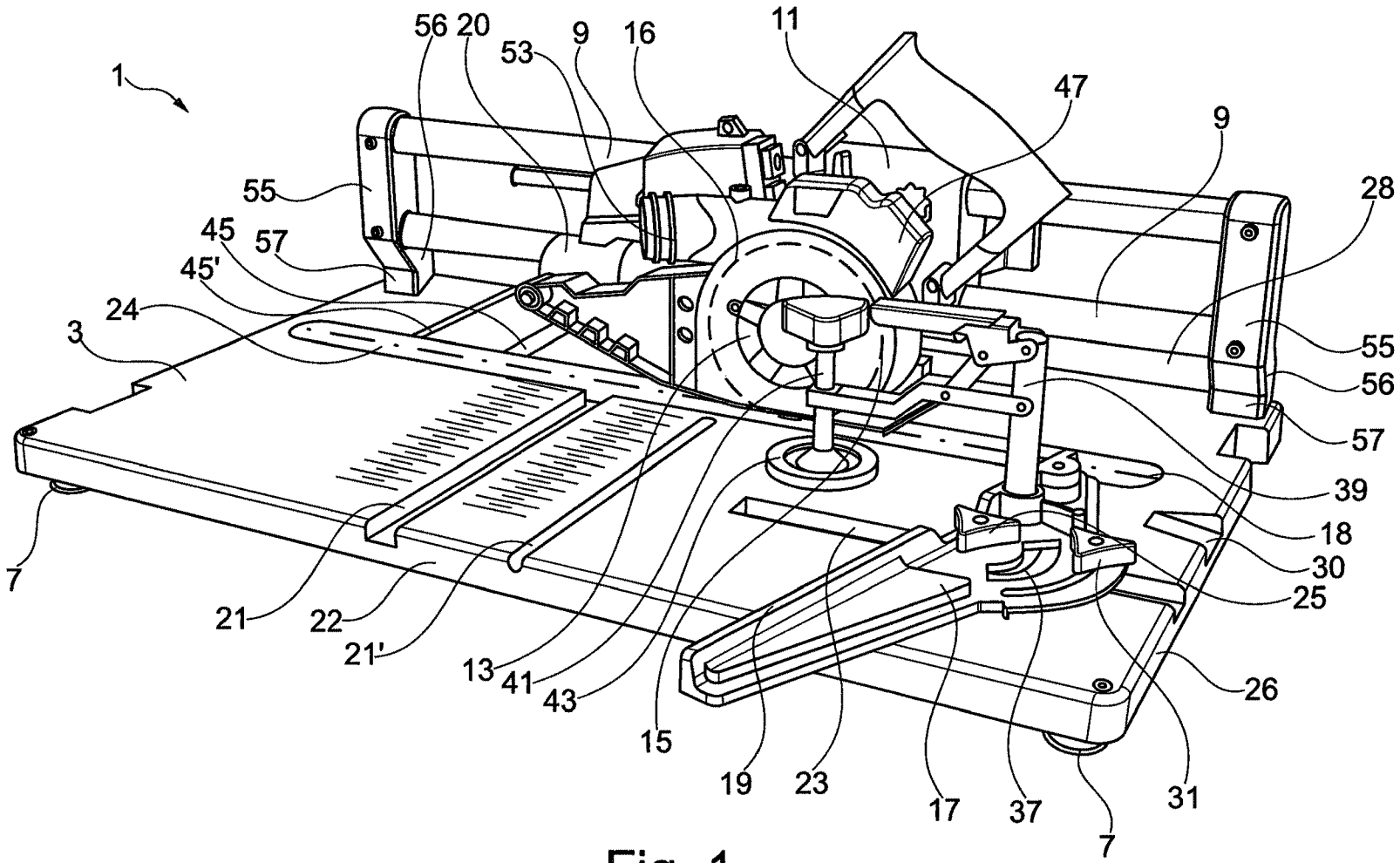
FIG. 1 illustrates a perspective view of an apparatus in accordance with an embodiment of the present invention.
Figure 2:
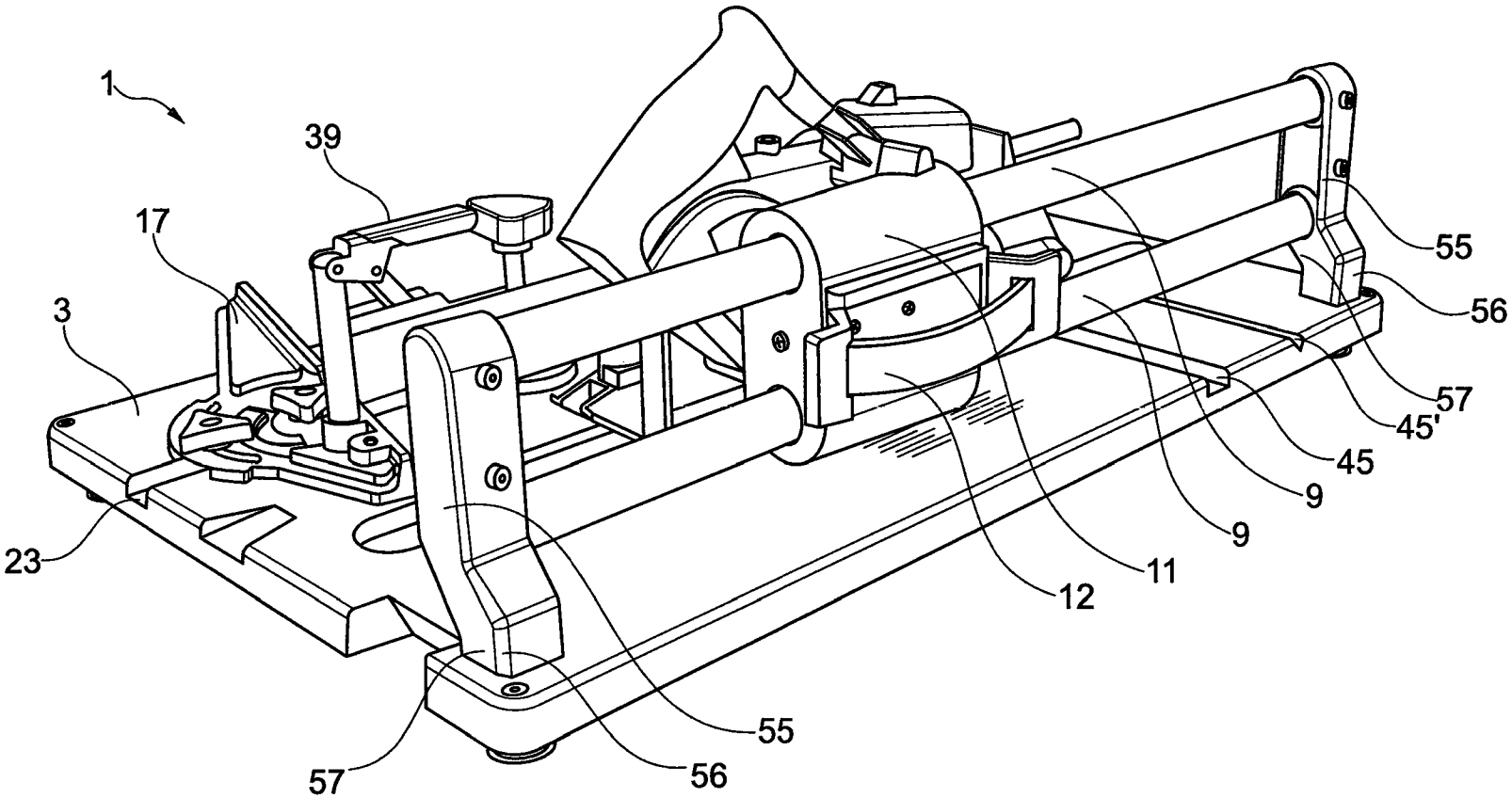
FIG. 2 illustrates a rear perspective view of an apparatus in accordance with an embodiment of the present invention.
Figure 3B:
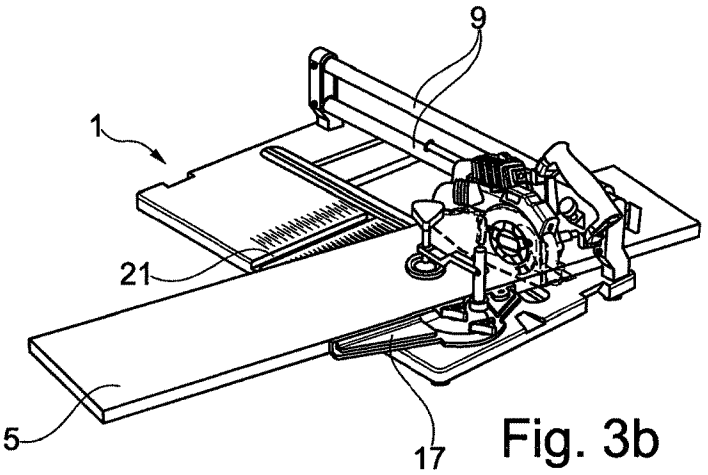
Figure 3D:
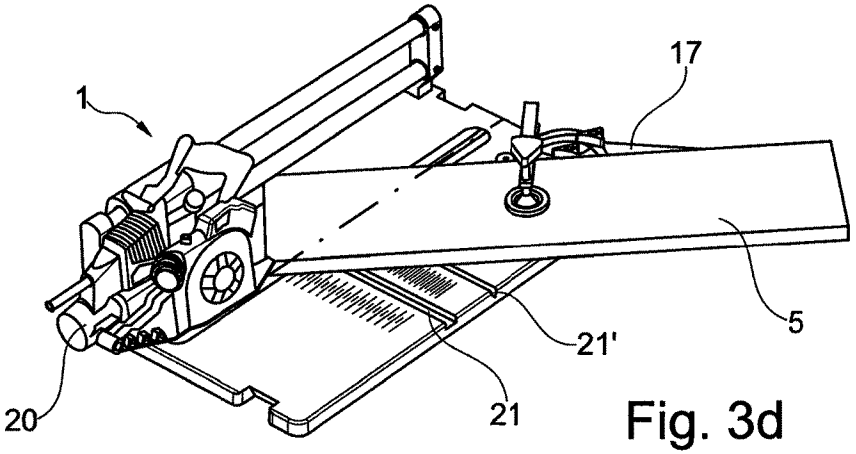
Figure 3A:
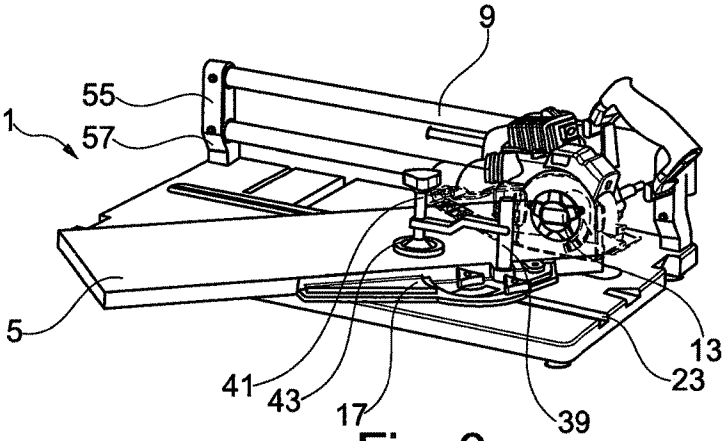
Figure 3C:
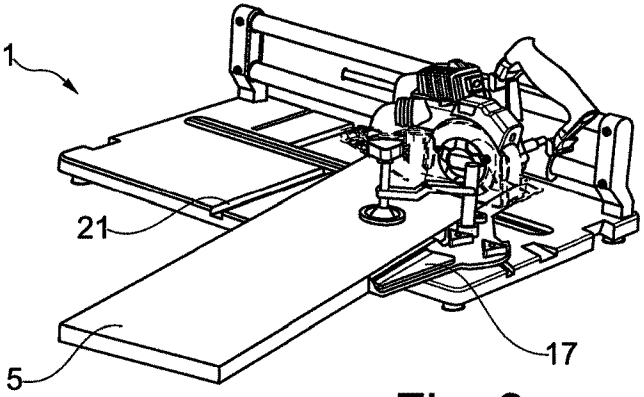
Figure 4C:
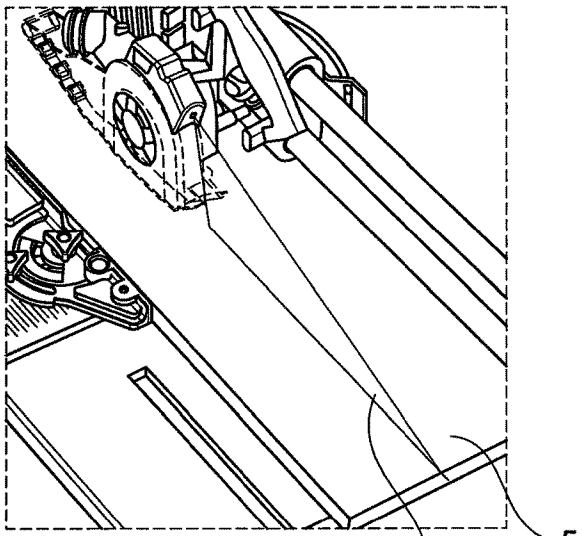
Figure 4A:
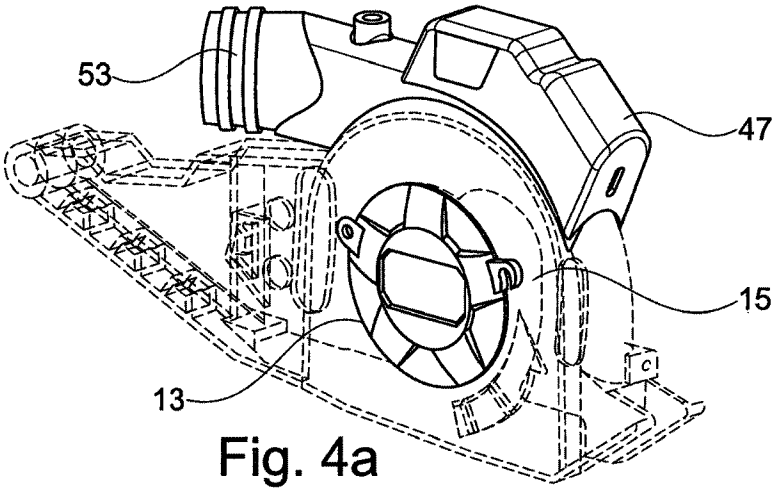
Figure 4B:
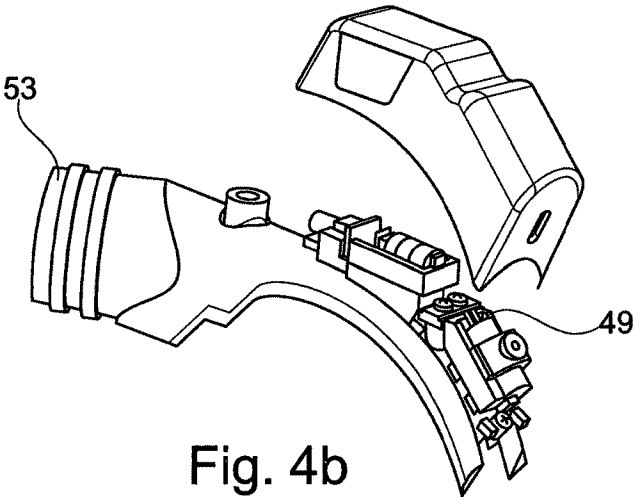
Figure 5:
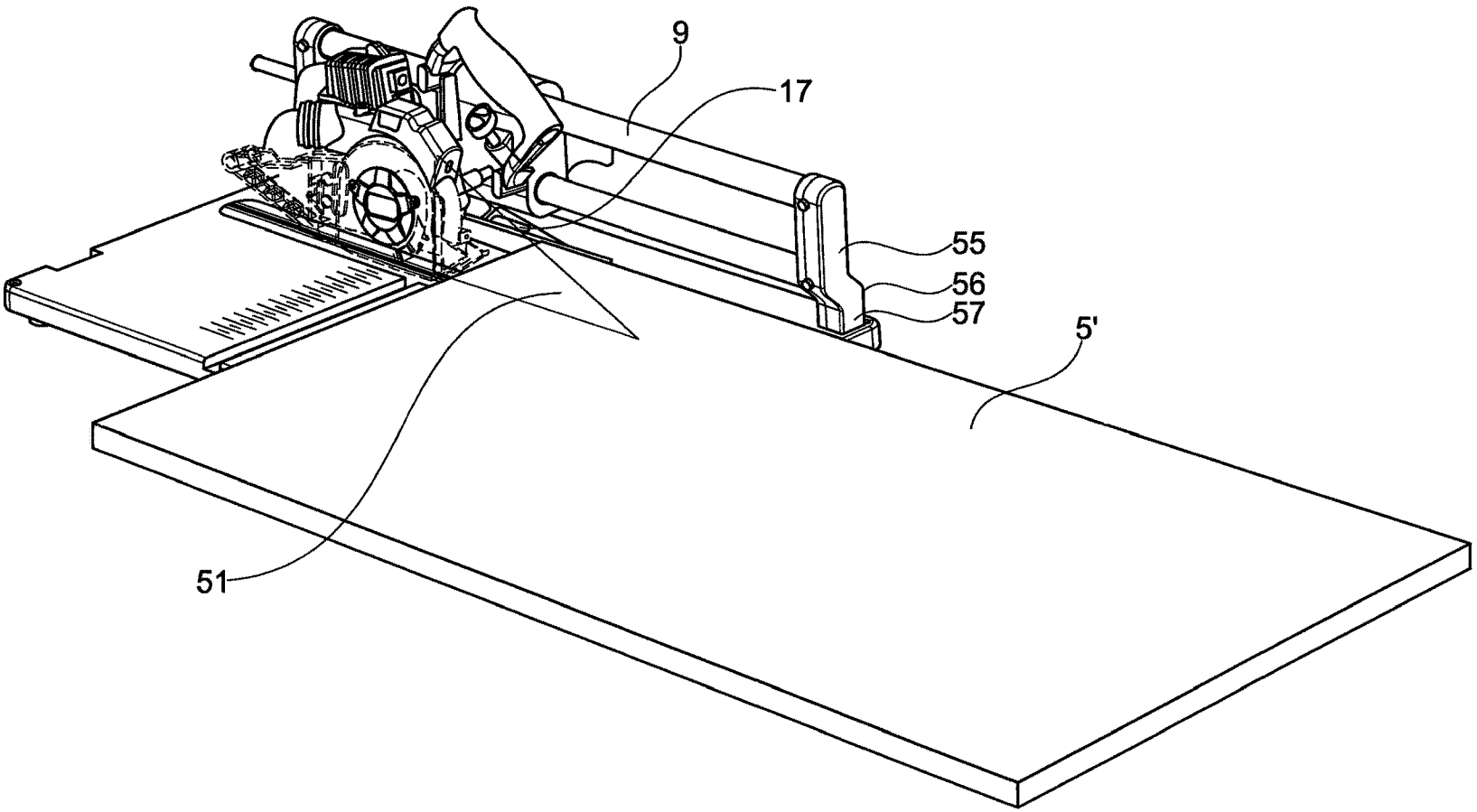
Figure 7:
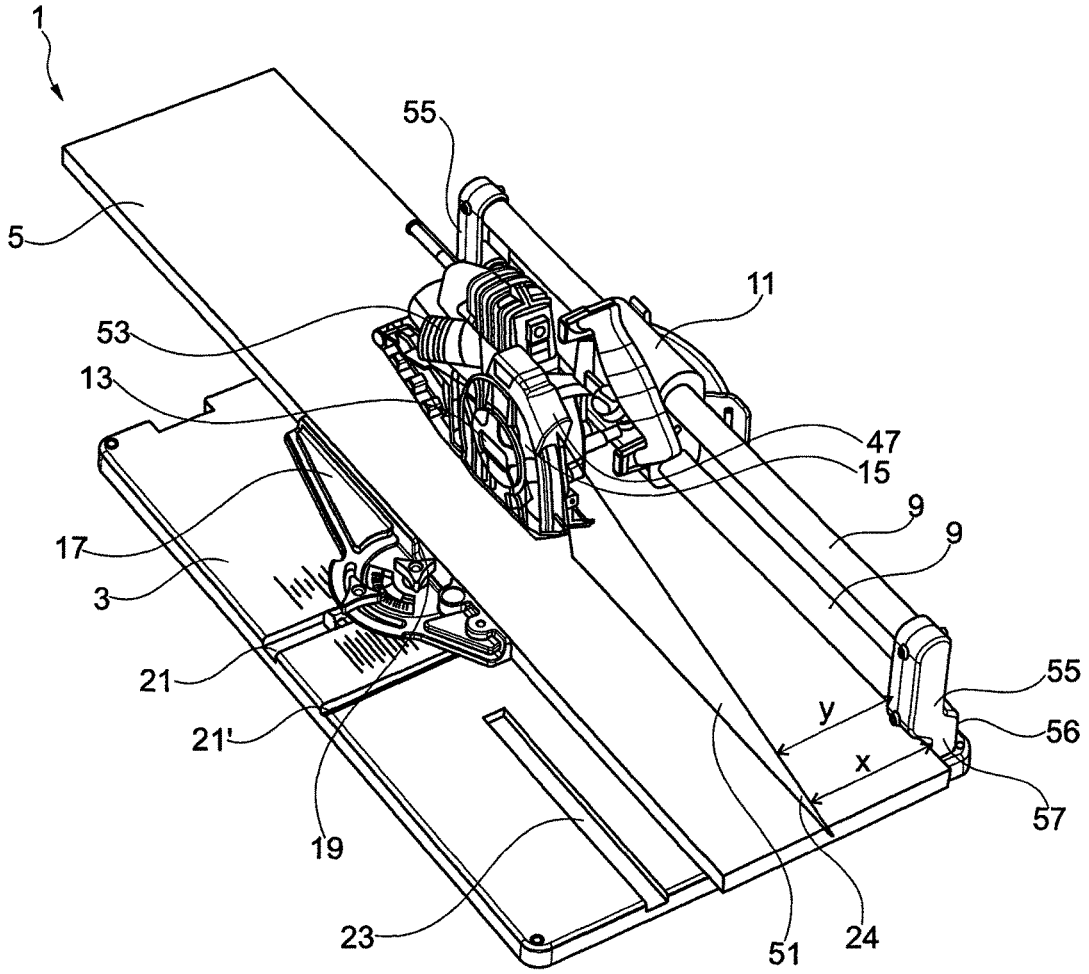
Figure 8A:
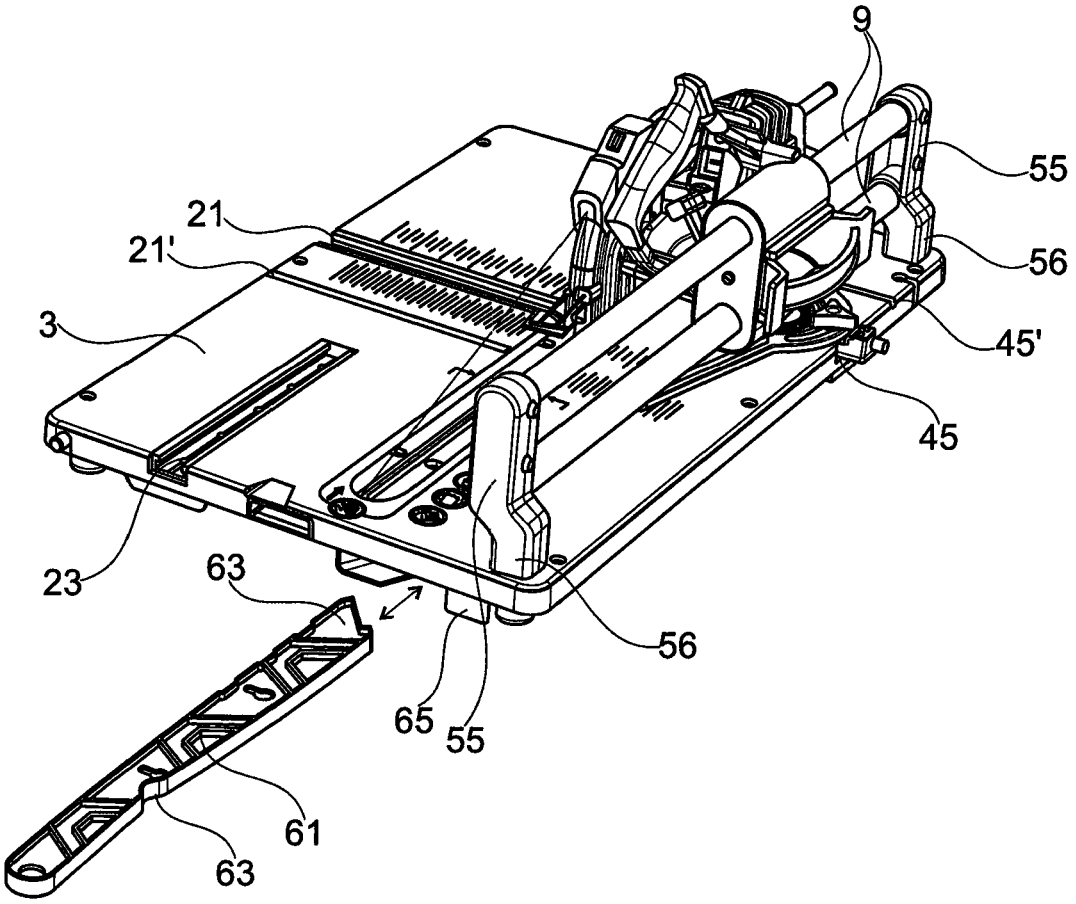
Figure 8B:
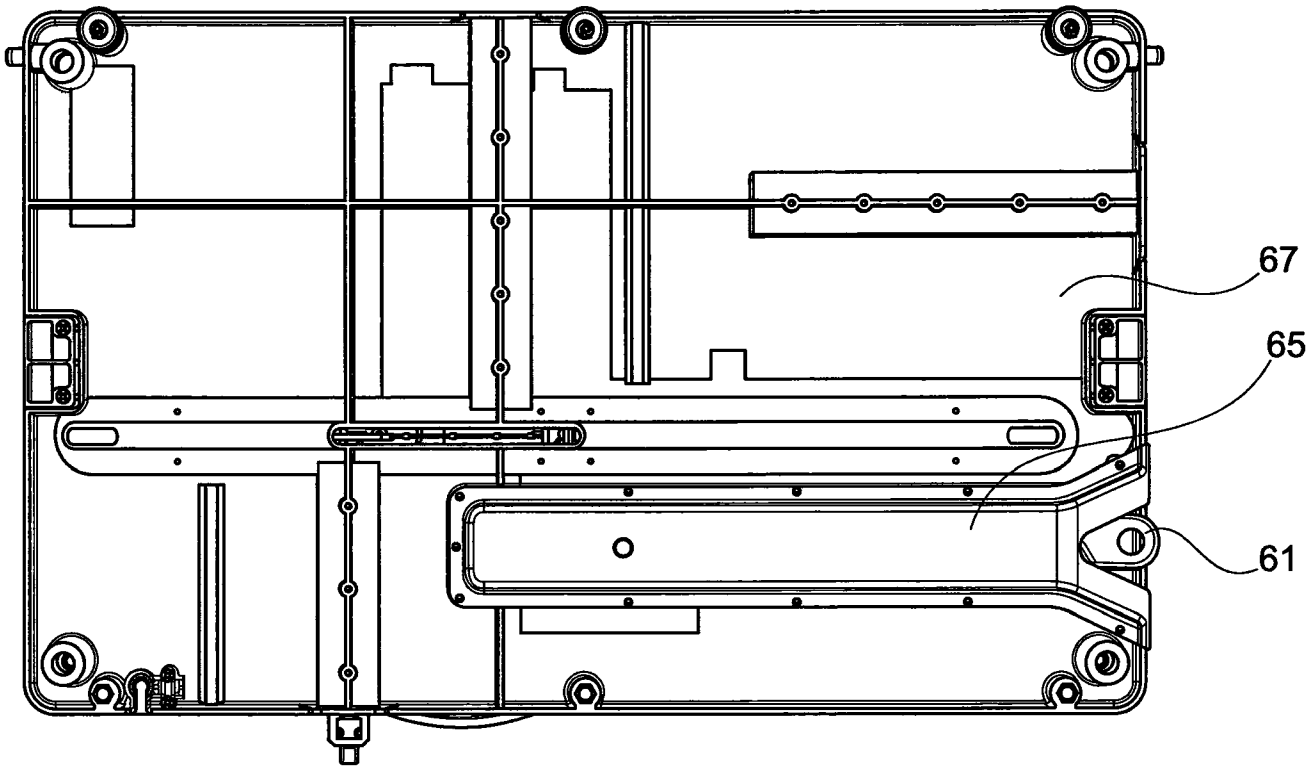
Figure 9A:
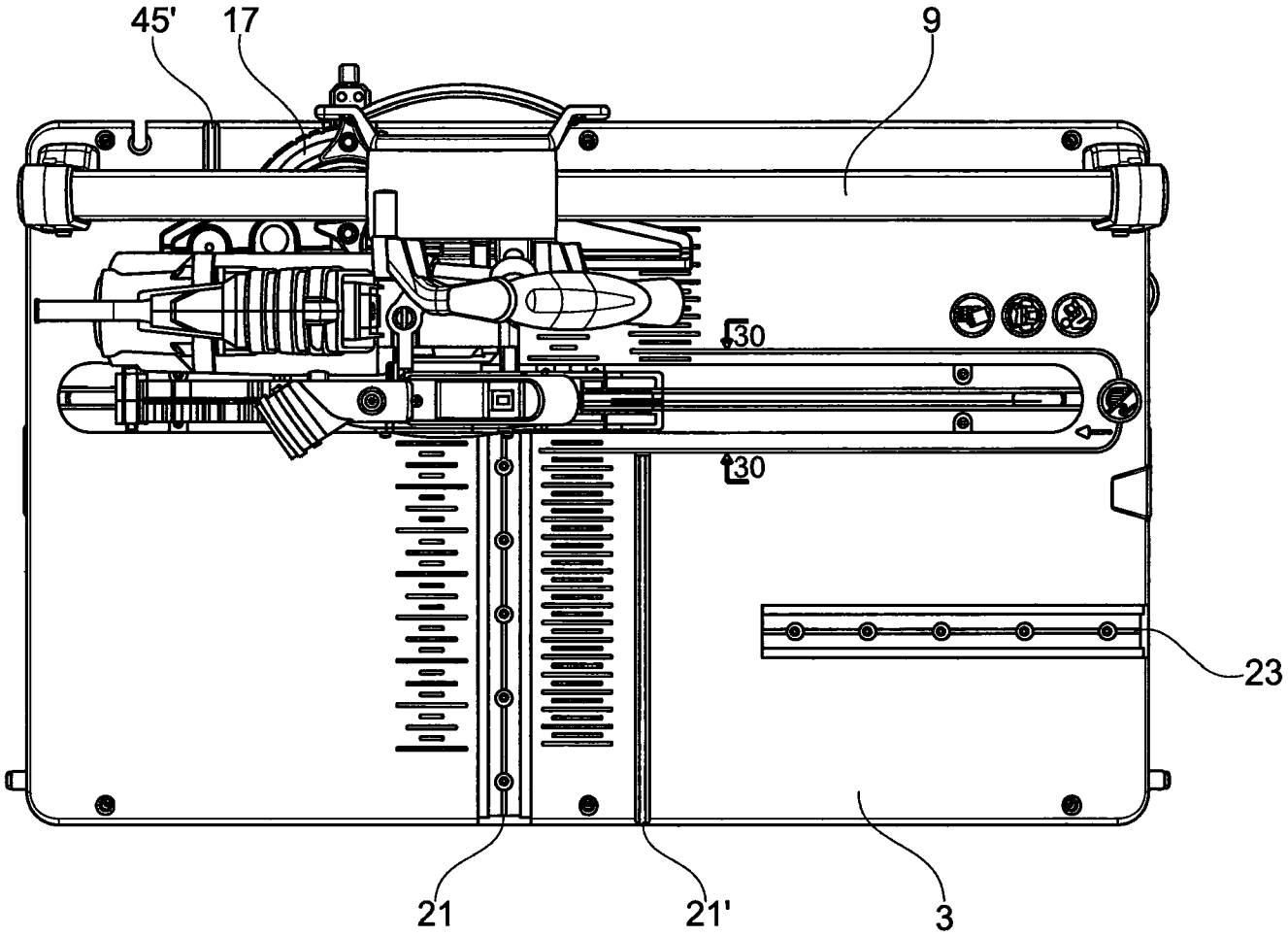
Figure 9B:
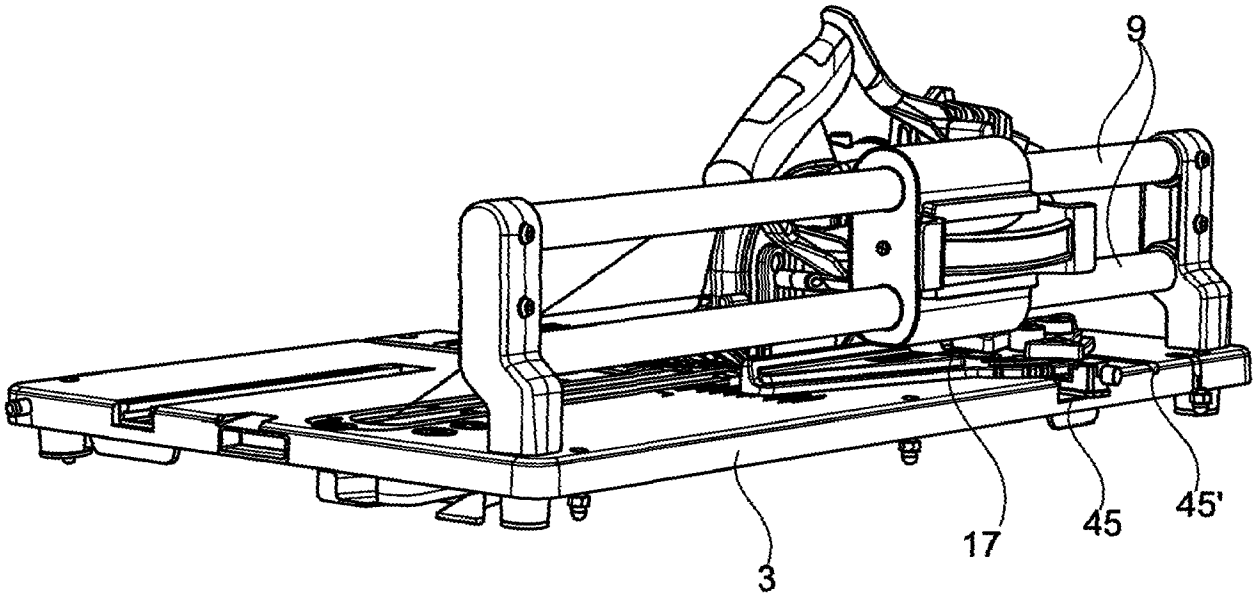
Figure 10:
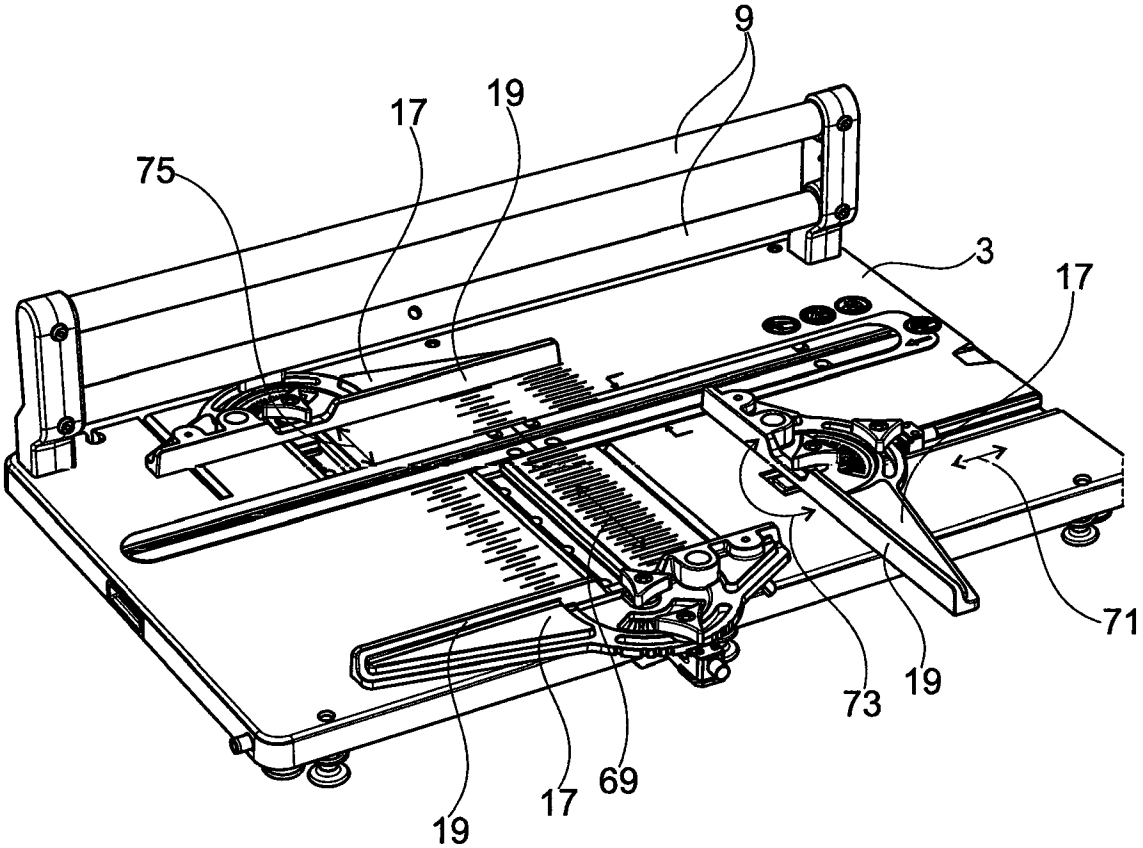

FIGS. 3*a-d* illustrate perspective views of a work piece located in various positions on an apparatus in accordance with an embodiment of the present invention;

FIGS. 4*a-c* illustrate perspective views of an adjustable cutting guideline generator in accordance with an embodiment of the present invention;

FIG. 5 illustrates a perspective view of a larger work piece located on an apparatus in accordance with an embodiment of the present invention;

FIGS. 6*a-d* illustrate perspective and exploded views of a fence for use with an apparatus in accordance with an embodiment of the present invention;

FIG. 7 illustrates a perspective view of a work piece located on an apparatus including support legs in accordance with one embodiment of the invention;

FIGS. 8*a* and *b* illustrate perspective and plan views of the apparatus showing the provision of a pushing member as part of the apparatus in accordance with one embodiment of the invention;

FIGS. 9*a-b* illustrate a plan view and a perspective view showing the location of the fence on third guide means in accordance with one embodiment of the invention; and FIG. 10 illustrates a plan view showing the possible location of the fence with the respective guide means in accordance with one embodiment of the invention.

The present invention addresses the problem of providing an apparatus of a form which can be used to perform a cutting action on a work piece such as laminate flooring, flooring panels or the like and to allow the cutting action to be performed on site and in an accurate manner and providing an increased number of cutting angles that a work piece may be cut along. The present invention also serves to address the problem of providing such an apparatus with a means to ensure accurate cutting along the cutting line is achieved and that will maximise the size of the workpiece which can be cut without compromising the portability of the apparatus.

Referring firstly to FIGS. 1-3*d*, there is provided in accordance with one embodiment of the present invention an apparatus (1). The apparatus (1) includes a base (3) onto which a work piece (5) to be cut can be placed. The base (3) is generally constructed from cast metal such as aluminium but may be made from wood or ply wood material, or other suitable material. Supporting feet (7) are provided at the corners of the base (3) and are formed from an anti-slip material so as to prevent the base (3) from sliding along a support surface when in use. The apparatus (1) further includes slide members (9) upon which a sliding member (11) is mounted. The sliding member is provided as part of a cutting unit (13). The cutting unit also includes a rotatable blade 16 shown in broken lines which is located within a guard (15) for the same. A lower portion of the blade protrudes into a recess or aperture 18 in the base so that the blade will cut through the workpiece placed on the base with the cut line 24 of the blade defined as a straight cut line in the same position with respect to the base, whether the cut line be formed by moving the cutting unit along the slide members in one use or being locked in a fixed position on the slide members and the workpiece moved past the cutting blade in a second use, for each cut which is performed. The cutting unit 13 also includes a motor 20 for rotating the blade when it is switched on and a handle 12. The cutting unit (13) is mounted on one side of the slide members (9) such that the blade is spaced a predetermined and fixed distance from the slide members (9). The cutting unit can be slid along the slide members to perform the cut on a workpiece which is held in a stationary position on the base 3. Alternatively the cutting unit can be locked in a fixed position with respect to the slide members typically by the location of a pin provided on the cutting unit passing into an aperture provided on one of the slide members and biased to be retained in the at position. With the cutting unit in a fixed position the workpiece can then be slid past the rotating blade to perform the cut. A moveable fence (17) is provided on the base (3) and has a contact surface (19) against which an edge of a work piece (5) to be cut may be positioned, in order that it is held firmly in position as it is being cut by the blade. Depending on the nature of cut required to be made on the work piece (5), the fence (17) is moveable between positions on a first guide means, shown in this instance as two parallel slots (21, 21') extending from edge 22 and running perpendicular to the cutting line of the rotatable blade and the slide members, second guide means, shown as a single slot (23) extending from edge 26 and running parallel to the cutting line 24 and slide members and third guide means in the form of two parallel slots 45, 45' extending from edge 28 and running perpendicular to the cutting line of the rotatable blade and the slide members.

Figure 6A:
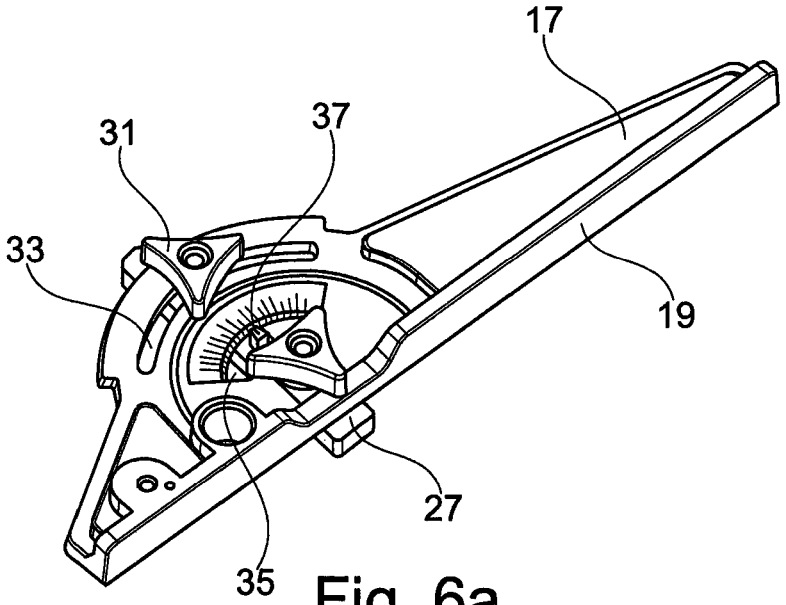
Figure 6B:
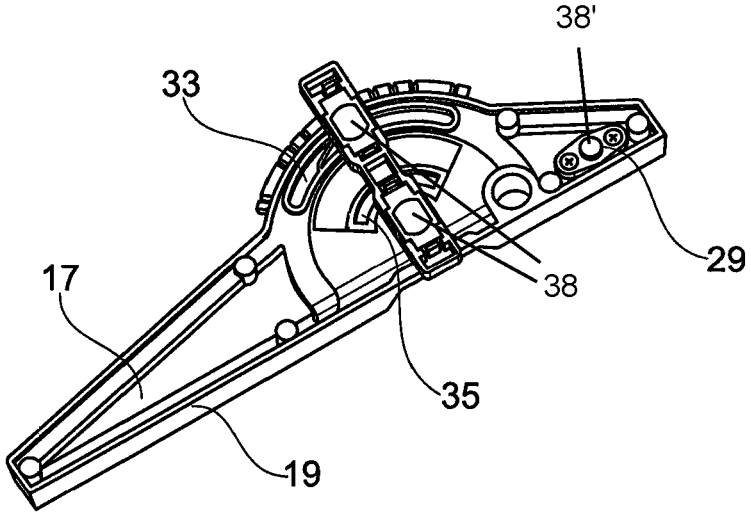
Figure 6C:
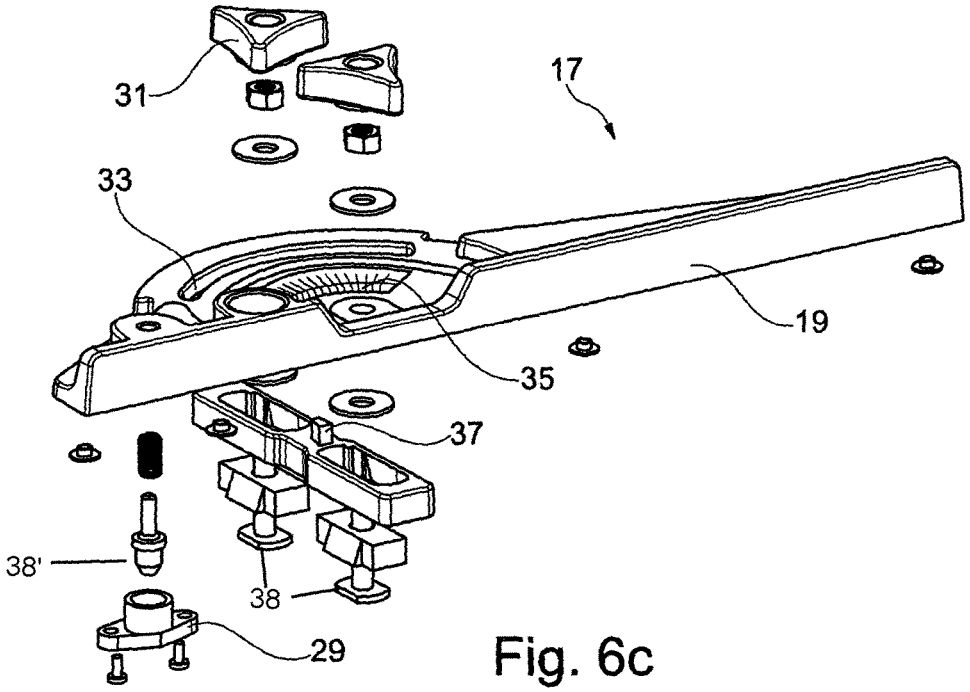
Figure 6D:
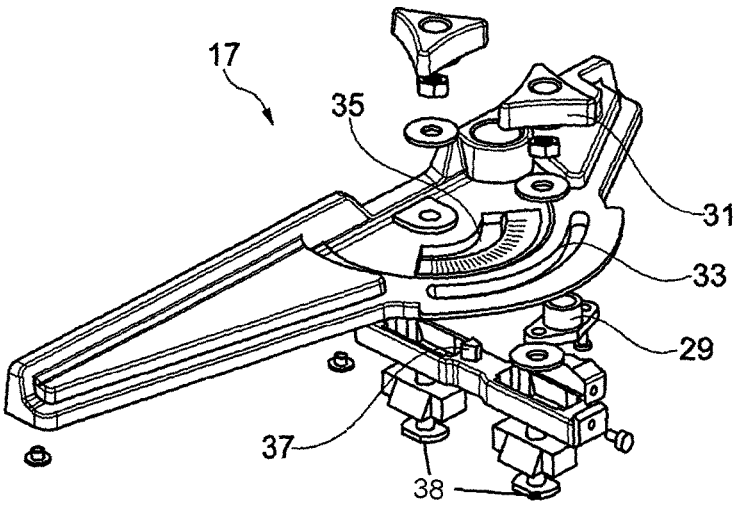

When the fence assembly (17) is located on the first guide means (21), it can be moved towards and away from the cutting unit but the contact face (19) is always positioned to be substantially parallel with an elongate axis of said slide member and the cutting line 24. This is achieved by the fence including a guide pin 38 as shown in FIGS. 6*c* and 6*d*, which is located in one of the slots 21 and a second guide pin 38' which is located in the other of the slots 21' and along which slots the pins 38, 38' move simultaneously. The provision of the guide pins 38, 38' in the slots 21', 21 means that when the fence assembly is moved along the guide means 21,21' the contact surface 19 is retained in the parallel relationship as shown in FIG. 7. In one embodiment the guide pin can be moved to a position to protrude or is biased into a position to protrude into the guide means 21' when the fence assembly is to be used for this purpose while the guide pin to be received in slot 21 may also be biased or is fixed in a protruding position. The positioning of the fence assembly (17) in this manner allows the user to make cuts in the work piece (5) generally along its length and with the grain (rip cuts) with the work piece (5) secured in position.

When the fence assembly (17) is located on the second guide means (23), only one of the guide pins 38 of the fence assembly engages with the single slot 23 and the other guide pin 38' is retracted. This means that the fence assembly is pivotally movable about a pivot point (25) on the slot 23 and the position of the pivot point can be altered by sliding the pin along the slot 23. The other pin is initially moved to the retracted position when the same contacts with a ramp portion 30 provided at the edge 26 of the base. The ramp has an open end at the edge which is lower so that the guide pin initially hits that when the fence is being moved onto the slot 23 and as the fence is moved inwardly from the edge the contact between the rising ramp portion and the guide pin causes the guide pin to move up so that the free end is at the level of the top surface of the base, typically against a biasing force provided by a spring, to a retracted position within the fence and so does not provide any guiding effect. In this arrangement the fence is movable about pivot point (25) and this allows the fence contact surface 19 to be angularly adjustable and allows the work piece (5) to be cut at various angles selected by the user (mitre cuts and cross cuts) as illustrated in FIGS. 3*a-d*.

Third guide means (45, 45') are provided on the base (3) for positioning the fence assembly (17) to the opposing side of the apparatus (1) from the first guide means as is illustrated in FIG. 5 and FIGS. 9*a-b* (i.e. such that the fence can be located underneath the slide members (9) and on the same side of the cutting line 24 of the rotatable blade as the guide rails (9)). This is provided such that a user can perform cuts on larger work pieces (5'). The arrangement of the third guide means (45, 45') is similar to that of the first rail means (21, 21') in that two parallel slots (45, 45') run perpendicular to the cutting line 24 of the rotatable blade are provided, such that when the fence (17) is located on the third guide means (45, 45'), it remains fixed so the contact surface (19) runs in a plane substantially parallel with the cutting plane of the rotatable blade.

The cutting apparatus (1) described in the present application therefore has the advantage that the fence (17) that is provided on the base (3) and when in located on the second rail means (23) is adjustable about a wide range of angles, allowing a work piece (5) to be cut to fit its location with much greater accuracy and the provision of the first and third guide means allows the provision of a parallel contact surface to be provided on the base at a number of different locations whilst, importantly, still being able to use the same fence. Unlike previous apparatus, the apparatus (1) of the present invention provides a user with the facility to make suitable cross cuts, rip cuts, and a wide variety of mitre cuts on a work piece (5). FIG. 10 illustrates the possible location of the fence 17 on the three guide means 21, 23 and 45 for the purposes of illustration and illustrates via arrows 69, 71, 73 and 75 the possible movement of the fence assembly when located on each of the guide means.

With reference to FIGS. 6*a-d* when the fence assembly (17) is located on the guide means, it can be subsequently secured in place with a locking assembly (27) in the form of threaded bolts, screws and/or a cam mechanism. When located in the first or third guide means, a further bolt (29) is provided to run along the second and parallel slot (21'; 45'). This ensures the contact surface (19) of the fence assembly (17) is maintained in a fixed plane parallel to the cutting plane of the blade and results in an accurate rip cut along the work piece (5) when such a cut is required. The fence assembly (17) can be moved along the slots (21, 21'; 45,45') to suit the width of the work piece (5) and the cut that is required. The location of the first guide means is provided such that the cutting line 24 of the rotatable blade is between the first guide means and the slide members (9).

When the fence is on the second guide means then once the fence (17) is located thereon, the contact face (19) of the fence (17) is angularly adjustable about the pivot point (25) and once the angular adjustment of the fence assembly (17) is achieved, the threaded screw or bolt (31) which rests in the fence slot (33) can be tightened. A further slot (35) is provided in the fence assembly (17) in which an angle pointer (37) connected to the base (3) lies. The extent of length of the slot (35) determines the degree of angular adjustment that will be possible. In one use, the cut can be directly across at 90° or a range of predetermined angular positions such as macro angles of plus or minus 15°, 20°, 22.5°, 30°, 45° to be achieved are defined. Thus, when the fence assembly (17) is positioned on the second guide means (23), the user may position the work piece (5) across a broad range of angles with respect to the cutting plane of the rotatable blade, providing an increased number of mitre cutting options for the user.

A clamp device (39) is provided with the apparatus (1) and includes a threaded rod (41) with a foot (43). The foot (43) is formed so as to prevent damage to the work piece (5) against which the same is clamped. This clamp (39) is therefore used to maintain the work piece (5) in a position on the base (3) while the user performs the cutting action.

The guard (15) of the cutting unit (13) is provided with an adjustable cutting guideline generator (47) as is illustrated with reference to FIGS. 4*a-c*. The generator (47) includes a laser generator (49) with the leading face being formed so as to ensure that there is a free path along the cutting line 24 of the work piece (5) for a guideline (51) which is generated. Alternatively, or in addition to the laser generator (49), other illumination means (such as LEDs) may be provided to illuminate the portion of the work piece (5) adjacent to the blade at any given time. It should be appreciated that the cutting guide (47) as herein described may be used on other designs and cutting apparatus and is not confined to use with the apparatus (1) herein described. The position of the laser generator (49) on the guard (15) is adjustable, allowing the guideline (51) that is produced to be aligned with the line of the cut, or both or either side of the kerf of the cutting blade.

The guard (15) can also be provided with, or have attached thereto, a dust collection channel (53) through which dust or debris created during the cutting operation of the blade can be removed from the vicinity, allowing the dust and debris to be collected. Collection of the dust and debris can by a bag connected to the channel (53) or by other vacuum apparatus. Typically the dust and debris is collected from the cut area by the airflow created by rotation of the blade and carried upwardly and around the guard (15) by the airflow to an exit aperture, typically located at a tangent to the airflow above the blade.

The slide members (9) of the cutting apparatus (1) are supported in place by a pair of support legs (55). The lower portions 56 of each of the support legs (55) are provided so as to be placed at a distance X from the cutting line which is greater than the distance Y of the remainder of the support legs from the cutting line 24 as illustrated in, for example, FIG. 7. This gives the support legs a "dog-leg" profile (57). The dog-leg profile (57) is provided on the support legs (55) such that the lower portions 56 of the respective support legs (55) are located outwardly from the cutting plane of the rotatable blade with respect to the upper portion of the support legs (55) and hence allows the receipt of the edge of a workpiece 5 at the lower portions 56 and so increasing the width of the work piece (5) that may be cut, as depicted in FIG. 7.

Turning now to FIGS. 8*a* and *b* there is shown one form of the apparatus in which there is provided a pushing member 61 which can be used to guide the movement of a workpiece past the cutting blade in one embodiment of use of the apparatus. The member has a series of formations 63 which can be used to contact the workpiece and move the same and thereby avoids the need for the user to contact the workpiece directly in order to move the same and hence avoids the need for the user to place there hands close to the cutting blade in operation of the apparatus. In accordance with the invention the pushing member 61 is located for storage in a housing 65 located on the underside 67 of the base 3 as shown.

The invention claimed is:

1. A powered cutting apparatus, said apparatus comprising a base having a surface onto which a work piece to be cut can be placed, first and second spaced parallel slide members, a fence having a surface for location of the work piece therewith and a cutting unit, said cutting unit including a rotatable blade, a guard for the rotatable blade, and drive means for rotating said blade when switched on, said cutting unit mounted on, and to one side of, the slide members such that the blade is spaced to one side of the same along a plane substantially parallel with the said surface of the base;

wherein the base includes first guide means including first and second slots extending from an edge of the base surface and running perpendicular to the cutting line of the rotatable blade, and provided for location of the said fence via first and second pins provided on the fence such that the said fence surface is positioned in a plane parallel with the longitudinal axis of said slides and movable perpendicular thereto, and at least second guide means are provided, including a single slot extending from an edge of the base surface and running parallel to the cutting line of the rotatable blade, with which said fence is located via one of said first or second pins, with the other of the first or second pins at least partially retracted so as to allow the position of said fence to be angularly adjustable by the user.

2. Apparatus according to claim 1 wherein the fence is selectively positionable at any one of a range of predetermined angular positions.

3. Apparatus according to claim 1 wherein the positioning of the fence on said first and/or second guide means is user selected and then locked using one or more locking means.

4. Apparatus according to claim 1 wherein said first guide means are located in the apparatus such that the cutting line of the rotatable blade is located between the first guide means and the slide members.

5. Apparatus according to claim 1 wherein the length of said slots, of the first guide means, defines the extent of variation in the position of a contact face of said fence, and guides the movement of the fence such that the contact face of the fence is maintained in a parallel relationship with the cutting plane of the rotatable blade.

6. Apparatus according to claim 1 wherein said fence is rotatably adjustable with respect to the slot of the second guide means, allowing angular adjustment of a contact face of said fence and against which the work piece is located.

7. Apparatus according to claim 1 wherein said fence is pivotally movable when located with the second guide means to allow angular adjustment within a predefined range of ±45 degrees.

8. Apparatus according to claim 1 wherein the said fence includes clamp means to clamp the workpiece in position.

9. Apparatus according to claim 1 wherein at least a third guide means is provided and located on the same side of the cutting line of the rotatable blade as said slide members.

10. Apparatus according to claim 9 wherein said third guide means is located in the base underneath said slide members.

11. Apparatus according to claim 1 wherein the apparatus further includes an adjustable cutting guideline generator mounted on the cutting unit.

12. Apparatus according to claim 11 wherein said adjustable cutting guideline generator is provided to generate a laser or LED guideline onto the workpiece which is to be cut.

13. Apparatus according to claim 11 wherein the generator is adjustable in position on the cutting unit so as to allow the guideline produced by the generator to be aligned with the line of cut, or both or either sides of the kerf of the blade.

14. Apparatus according to claim 1 wherein the slide members of the powered cutting apparatus include support legs to hold the slide members in position with respect to the base and at least one of said support legs is provided with a portion located adjacent the base which is located at a distance further from the cutting line of the rotatable blade than another portion of the same support leg.

15. Apparatus according to claim 14 wherein the plurality of support legs are provided of the same shape and locate with the slide members to support the slide members at spaced locations therealong.

* * * * *